United States Patent [19]

Tashiro et al.

[11] Patent Number: 4,621,020

[45] Date of Patent: Nov. 4, 1986

[54] POLYESTER FIBERS

[75] Inventors: Mikio Tashiro; Kou Tsukiyama, both of Matsuyama, Japan

[73] Assignee: Teljin Ltd., Osaka, Japan

[21] Appl. No.: 722,258

[22] Filed: Apr. 12, 1985

[30] Foreign Application Priority Data

Apr. 13, 1984 [JP] Japan ..... 59-73008

[51] Int. Cl.[4] ..... D02G 3/00; D21F 11/00; D21H 5/12

[52] U.S. Cl. ..... 428/361; 162/157.3; 428/395; 428/401

[58] Field of Search ..... 162/157.3; 428/359, 428/361, 362, 375, 395, 401; 8/115.6; 528/295; 524/47, 503, 603

[56] References Cited

U.S. PATENT DOCUMENTS

| | | | |
|---|---|---|---|
| 2,905,585 | 9/1959 | Hubbard et al. | 428/375 X |
| 3,498,821 | 3/1970 | Hanson | 8/115.6 |
| 3,528,947 | 9/1970 | Lappin et al. . | |
| 3,546,008 | 12/1970 | Shields et al. | 428/395 |
| 3,702,260 | 11/1972 | Jayne et al. | 428/362 X |
| 3,730,830 | 5/1973 | Driscoll | 162/157.3 |
| 4,156,073 | 5/1979 | Login | 428/395 X |
| 4,483,976 | 11/1984 | Yamamoto et al. . | |
| 4,496,583 | 1/1985 | Yamamoto et al. | 162/157.3 X |

*Primary Examiner*—Lorraine T. Kendell
*Attorney, Agent, or Firm*—Sughrue, Mion, Zinn, Macpeak & Seas

[57] ABSTRACT

A papermaking polyester fiber having a denier number within the range of from about 0.1 to about 3.0 and a length within the range of from about 5 mm to about 25 mm and providing a packing factor of more than about 40 and a quantity of residual fibers of less than about 1000 mg on a flat screen plate when measured by a flat screen method.

10 Claims, 3 Drawing Figures

POLYESTER FIBERS

FIELD OF THE INVENTION

The present invention relates to polyester fibers and particularly to polyester fibers which are useful as papermaking materials to produce paper having improved mechanical strengths, feels and textures and which will provide improved work efficiency in packing operations using, for example, a box-type staple baling machine.

BACKGROUND OF THE INVENTION

As papermaking materials have typically been used natural cellulose fibers, rayon fibers and vinylon fibers. These conventional materials are however being now superseded by polyester fibers in some quarters of the papermaking industry for the reduction of production costs and to meet the intensifying requirements for the performance quality of paper and paper products. One of the reasons for this is the superiority of the polyester fibers over the conventional papermaking materials in, for example, mechanical and electrical properties, resistance to heat, dimensional stability and hydrophobic properties. Polyester fibers are thus considered to take the place of the conventional papermaking materials at an accelerated rate from now on, to keep pace with the growing requirements for higher quality as the industrial structure advances.

Used as the papermaking materials are short polyester fibers which are in most cases manufactured for use as textile materials. Such polyester fibers are thus added with one or more of an anionic surfactant such as a potassium laurylphosphate, a nonionic surfactant such as a fatty acid alcohol with an additive of ethylene oxide, and a cationic surfactant such as a quaternary ammonium salt. This is intended principally to improve the passability of the fibers through a carding machine, the antistatic property and the sliver-forming ability of the fibers and to reduce the roller wrap-up tendency of the polyester fibers. Addition of these surfactant compounds is however practically useless for the purpose of improving the dispersibility of the fibers or, if they are of any use at all, the degree of usefulness is only quite limited. Extreme difficulties are encountered when relatively long polyester fibers with relatively small denier numbers in particular are to be dispersed uniformly.

Known polyester fibers for use as papermaking materials for this reason inevitably have extremely low degrees of dispersibility, which require the fibers to be processed with extremely low degrees of fiber density during a paparmaking process. This is reflected by an extremely low production efficiency of papermaking with use of the conventional polyester fibers.

To provide a solution to this problem, we have proposed papermaking polyester fibers having a particular polyesterpolyether block copolymer deposited on the surfaces of the fibers, such polyester fibers being disclosed in Japanese Provisional Patent Publication No. 58-208500. The polyester fibers excel in dispersibility and have relatively high degrees of smoothness. Such high degrees of smoothness of the polyester fibers create difficulties when the fibers are to be packed, especially when they are relatively short and are to be packed in the baling box of a box-type staple baling machine. When the door of the baling box of the machine is opened up with the short polyester fibers stuffed and compacted in the box, fragments of the bale formed in the box may slip down out of the baling box and thus hinder the smooth stream of the baling operation. An excess of smoothness of the polyester fibers is further responsible for inadequate degrees of various mechanical strengths, such as tenacity, of the paper prepared from such fibers.

The present invention contemplates elimination of all these drawbacks of known polyester fibers used typically as papermaking materials and it is accordingly an important object of the present invention to provide polyester fibers with an increased degree of dispersibility and a reduced degree of smoothness. Another important object of the present invention is to provide polyester fibers having improved adaptability to papermaking materials and useful for the production of paper with increased degrees of mechanical strengths and of texture. Still another object of the invention is to provide polyester fibers which can be packed with ease and at an increased efficiency. The performance efficiency in packing or baling fibers will be herein referred to as "packing work performance" of the fibers.

SUMMARY OF THE INVENTION

In accordance with the present invention, there is provided a papermaking polyester fiber having a denier number within the range of from about 0.1 to about 3.0 and a length within the range of from about 5 mm to about 25 mm and providing a packing factor of more than about 40 and a quantity of residual fibers of less than about 1000 mg on a flat screen plate when measured by a flat screen method. The polyester fiber preferably comprises a fiber of polyethylene terephthalate, polyethylene terephthalate/isophthalate, or polybutylene terephthalate or, alternatively a fiber of a basic dye dyeable polyester, a non-inflammable or flame-retarded polyester, or an antistatic polyester. Such a polyester is preferably processed with a copolymerized polyester (I) which consists of (a) a polyester comprising terephthalic acid or an ester-forming derivative of terephthalic acid, isophthalic acid or an ester-forming derivative of the isophthalic acid and a lower polyalkylene glycol, (b) about 0.2 mol per cent to about 40 mol per cent, with respect to the quantity of the dicarboxylic acid component in the copolymer to be produced, of an ester-forming alkali metal sulfonate and (c) about 20 per cent by weight to about 90 per cent by weight, with respect to the quantity of the copolymer to be produced, of polyethylene glycol having an average molecular weight within the range of from about 500 to 12,000. The copolymerized polyester (I) may be applied to the polyester fiber in the form of a mixture with a second copolymerized polyester (II) comprising terephthalic acid or an ester-forming derivative of the terephthalic acid, isophthalic acid or an ester-forming derivative of the isophthalic acid, a lower polyalkylene glycol, and one or both of a polyalkylene glycol and a monoether thereof. The quantity of the copolymerized polyester (I) or the mixture of the copolymerized polyesters (I) and (II) to be deposited on the polyester fiber is within the range of from about 0.01 per cent by weight to about 2 per cent by weight. The quantities of the first and second copolymerized polyesters (I) and (II) in the mixture are preferably selected so that the quantity of the first copolymerized polyester (I) accounts for about 20 per cent by weight or more of the total quantity of the mixture.

BRIEF DESCRIPTION OF THE DRAWINGS

The features and advantages of a polyester fiber according to the present invention will be more clearly appreciated from the following description taken in conjunction with the accompanying drawings in which.

DETAILED DESCRIPTION OF THE INVENTION

A papermaking polyester fiber according to the present invention has a chemical composition comprising polyethylene terephthalate, polyethylene terephthalate/isophthalate, polybutylene terephthalate or the like. It is however to be noted that such a polyester fiber may be a fiber of any modified version of these compositions such as, for example, a basic dye dyeable polyester, a non-inflammable or flame-retarded polyester, and an antistatic polyester.

In accordance with the present invention, such a polyester fiber has a denier number within the range of from about 0.1 to about 3.0 and a length within the range of from about 5 mm to about 25 mm and provides a quantity of residual fibers of less than about 1000 mg or, preferably, less than about 500 mg or, more preferably, less than about 300 mg on a flat screen plate when measured by a flat screen method, as previously mentioned. A quantity of on-the-flat-screen-plate residual fibers higher than the preferred upper limit of about 1000 mg would result in degradation of the dispersibility of the fibers in papermaking operation and accordingly in reduction of the production efficiency of the papermaking operation since fibers can not be used with a satisfactory density.

Figure 1:
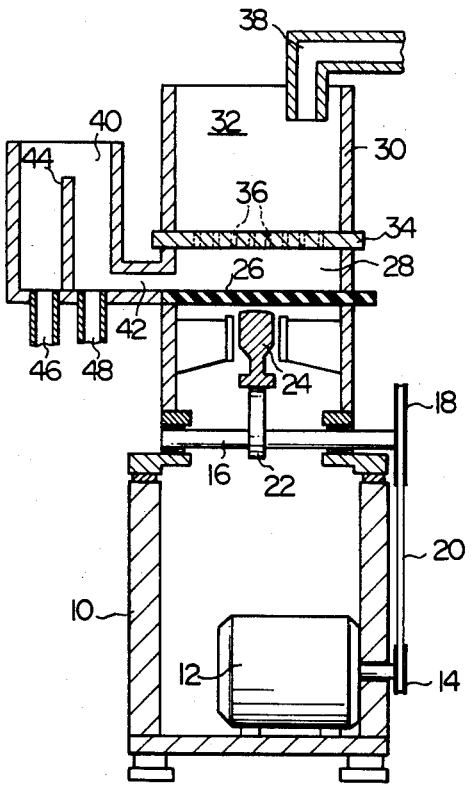
FIG. 1 is a vertical sectional view showing an example of a flat screen machine which may be used for the determination of the quantity of on-the-flat-screen-plate residual fibers of polyester fibers according to the present invention.

FIG. 1 of the drawings shows an example of a flat screen strainer with use of which the quantity of on-the-flat-screen-plate residual fibers of polyester fibers are to be measured in accordance with the present invention. The equipment shown in FIG. 1 comprises a lower base structure 10 having a bottom plate on which a motor 12 is supported. The motor 12 has an output shaft on which a drive pulley 14 is securely mounted. The base structure 10 has further supported thereon a drive shaft 16 journalled to the structure 10. The drive shaft 16 has a driven pulley 18 securely mounted on one of its end portions. An endless belt 20 is passed between the drive and driven pulleys 14 and 18 and thus transmits the rotation of the motor output shaft to the drive shaft 16. The drive shaft 16 further has an eccentric cam 22 securely mounted on its intermediate portion. The eccentric cam 22 is held in rollable engagement with a lower cam follower portion of an oscillator member 24 which is movable upwardly and downwardly with respect to the base structure 10 as the cam 22 turns about the center axis of the drive shaft 16. Immediately above the oscillator member 24 is positioned a rubber diaphragm 26 which defines the bottom of an oscilatory chamber 28 formed in an upper wall structure 30. The oscillator member 24 is engageable with the rubber diaphragm 26 and causes the diaphragm 24 to intermittently deform upwardly as the eccentric cam 22 is driven for rotation as will be readily understood.

The upper wall structure 30 has further formed therein a screening chamber 32 which is separated from the oscillation chamber 28 by a perforated flat screen plate 34 secured to the wall structure 30. The flat screen plate 34 is formed with a number of elongated slots 36 through which the screening chamber 32 communicates downwardly with the oscillation chamber 28. A water supply conduit 38 leading from a source of water (not shown) is open downwardly into the screening chamber 32. The upper wall structure 30 is further formed with a pulp refining chamber 40 which communicates with the oscillation chamber 28 through a passageway 42. The pulp refining chamber 40 has a bottom surface level with the bottom of the oscillation chamber 28. In the pulp refining chamber 40 is provided a vertically extending dam plate 44 having an upper end at a level higher than the bottom of the screening chamber 32 as shown. The dam plate 44 divides the pulp refining chamber 40 into two sections which merge with each other over the dam plate 44. A first water discharge port 46 leads from the bottom of the section of the pulp refining chamber 40 farther from the oscillation chamber 28 and a second water discharge port 48 is open upwardly into the other section of the pulp refining chamber 40 closer to the oscillation chamber 28.

Figure 2:
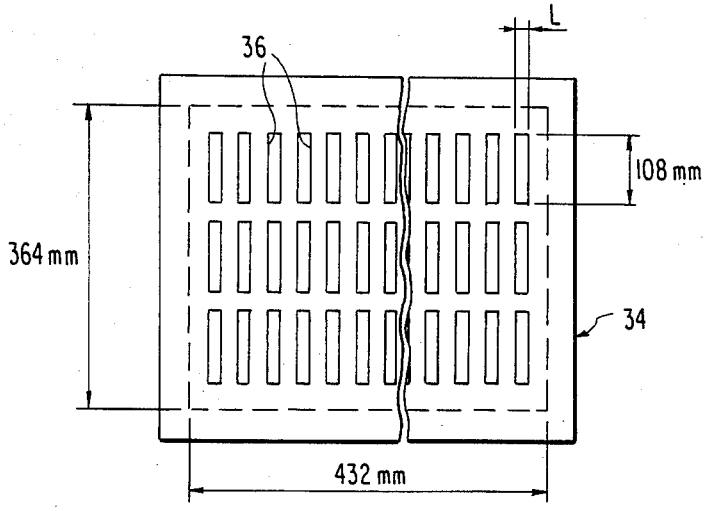
FIG. 2 is a fragmentary plan view showing the configuration of a flat screen plate forming of the machine illustrated in FIG. 1.

As will be better seen from FIG. 2 of the drawings, the elongated slots 36 in the flat screen plate 34 are arranged in three arrays each consisting of an N/3 number of slots 36, there thus being provided a total of N number of slots 36 in the plate 34 where N is an integer which is a multiple of three. The flat screen plate 34 has an effective area shown enclosed by broken lines. This effective area of the flat screen plate 34 is herein assumed to measure 432 mm by 364 mm and each of the elongated slots 36 in such a plate 34 is assumed to measure L mm in width and 108 mm in length. The total number N of the slots 36 in the flat screen plate 34 is selected so that the product of the number N and the length, FL, of a fiber are approximately equal to 2400 ($N \times FL = 2400$). Thus, the width L mm of each of the slots 36 is selected so that the "percentage vacancy" herein defined as $$(L \times 108 \times N)/(432 \times 364) \times 100$$

becomes approximately 10 per cent.

To determine the quantity of on-the-flat-screen-plate residual fibers of a polyester fiber with use of the flat screen strainer thus constructed and arranged, 25 g of polyester fibers are collected as a sample material and are put into the screening chamber 32 of the strainer in which water is preliminarily stored to the depth of about 10 cm from the upper face of the flat screen plate 34. The motor 12 is then actuated to drive the drive shaft 16 and cam 22 for rotation through the drive pulley 14, endless belt 20 and driven pulley 18. In this instance, the revolution speed of the motor output shaft is selected so that the eccentric cam 22 is driven for rotation at about 700 rpm about the center axis of the drive shaft 16. While the eccentric cam 22 is being thus driven for rotation, water is supplied into the screening chamber 32 at a rate of 20 ±1 liters per minute from the water supply conduit 38. The cam 16 drives the oscillator member 24 for alternately upward and downward movements with respect to the base structure 10 and causes the rubber diaphragm 26 to oscillate upwardly and downwardly at a frequency proportional to the revolution speed of the cam 22. The upward and downward oscillations of the rubber diaphragm 26 are transmitted through the water in the oscillation chamber 28 to the perforated flat screen plate 34, which is therefore subjected alternately to upward pressure and downward suction. The alternate pressure and suction applied to the flat screen plate 34 are transmitted through the slots 36 in the plate 34 to the polyester fibers submerged in the water in the screening chamber 32 and promote passage of the fibers through the slots 36. The dam plate 44 provided in the pulp refining chamber 40 serves to maintain constant the level of the water in the strainer throughout the screening operation thus performed. In about 10 minutes after the motor 12 has been started, the screening operation is terminated with the motor 12 brought to a stop. A fraction of the polyester fibers initially put into the screening chamber 32 is passed through the slots 36 in the flat screen plate 34, with the water, into the oscillation chamber 28 and the section of the pulp refining chamber 40 closer to the oscillation chamber 28. Thereafter, the water in the screening chamber 32 is discharged through the second water discharge port 48. The remaining fraction of the fibers which have failed to pass through the slots 36 in the flat screen plate 34 is left on the upper face of the plate 34. The fibers thus remaining on the flat screen plate 34 are collected and are, upon removal of water by centrifugation, dried at 105° C. for 90 minutes. The quantity of on-the-flat-screen-plate residual fibers of the sample fibers is thus given by the weight of the dried fibers measured in terms of milligrams. It will be understood that the lower the quantity of on-the-flat-screen-plate residual fibers the higher the dispersibility of the fibers in water and that the quantity of on-the-flat-screen-plate residual fibers determined as described above is for this reason a truly useful and reliable measure in evaluating the dispersibility in water of short polyester fibers destined for papermaking materials. No other parameters could be more pertinently refer to the dispersibility in water of such a material.

A polyester fiber according to the present invention is further characterized in that the fiber has a packing factor of more than about 40 or, preferably, more than about 45 as also mentioned previously. A packing factor of less than the preferred lower limit of about 40 might cause slipdown of the fragments of the bale out of a baling box and thus degrade the packing work performance of the fibers, viz., the performance efficiency of the baling operation. The packing factor herein referred to is measured with the use of a device schematically illustrated in FIG. 3 of the drawings.

Figure 3:
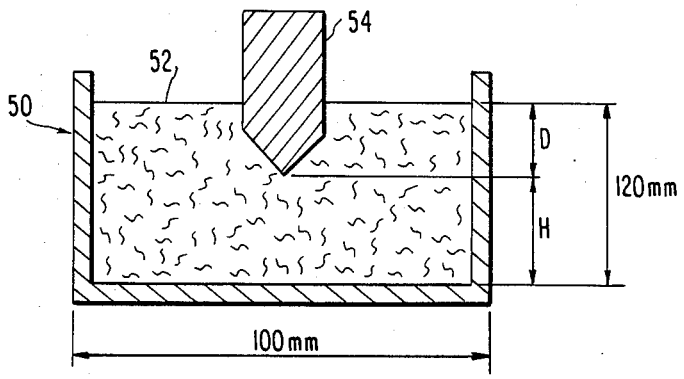
FIG. 3 is a vertical sectional view showing an example of a device which may be used for the determination of the packing factor of polyester fibers according to the present invention.

The device shown in FIG. 3 comprises an upwardly open, generally cylindrical vessel 50 adapted to have a certain quantity of fibers stuffed therein. The vessel 50 is assumed to measure 100 mm in diameter and 140 mm in height. In a method of measuring the packing factor as proposed by the present invention, 188 g of fibers 52 are used as a sample material and are put into the vessel 50. The fibers 52 are compacted in an appropriate manner to have a height of about 120 mm and a density of about 0.2 g/cm$^2$. A weight 54 of stainless steel having a stem portion measuring 50 mm in diameter and 100 mm in length and a conically tapered tip portion having a length of 25 mm is softly placed on the layer of the compacted fibers 52 with its tapered tip portion directed downwardly as shown. The weight 54 is thereafter allowed to sink into the layer of the fibers 52 for about 5 minutes, upon lapse of which the depth D to which the weight 54 has sunk into the fibers 52 is measured in millimeter. The packing factor is given by the difference H between the initial height 120 mm of the layer of the fibers and the depth D mm to which the weight 54 is allowed to sink into the layer ($H=120-D$). The larger the packing factor, the less likely will the fragments of the bale of the fibers be to slip down from the baling box and accordingly the higher will the packing work performance of the fibers be. The packing factor thus defined is considered to be an exact indication of the packing or baling performance of a fiber assembly which can not have been evaluated properly by any known parameters indicative of the various natures and properties of polyester fibers. The packing factor proposed by the present invention is closely correlated to the packing work performance of polyester fibers and can be determined precisely with use of a small quantity of sample fibers.

The papermaking polyester fiber according to the present invention is, furthermore, preferably processed with an additional compound having a particular composition. Operable as a preferred example of such a compound is a copolymerized polyester (I) which consists of (a) a polyester comprising terephthalic acid or an ester-forming derivative of terephthalic acid, isophthalic acid or an ester-forming derivative of the isophthalic acid and a lower alkylene glycol (b) about 0.2 mol per cent to about 40 mol per cent (with respect to the quantity of the dicarboxylic acid component in the copolymer to be produced) of an ester-forming alkali metal sulfonate and (c) about 20 per cent by weight to about 90 per cent by weight (with respect to the quantity of the copolymer to be produced) of polyethylene glycol having an average molecular weight within the range of from about 500 to 12,000. Polyester fibers with a quantity of on-the-flat-screen-plate residual fibers of less than about 1,000 mg and a packing factor of more than 40 can be obtained with such a copolymerized polyester (I) applied to the surfaces of the polyester fibers. The terephthalic acid or the ester-forming derivative thereof and the isophthalic acid or an ester-forming derivative thereof contained in this copolymerized polyester (I) provide acid components of the copolymerized polyester. To increase the dispersibility of the polyester fibers in water, it is important to use both of these two acid components. In this instance, it is preferable that the ratio between the terephthalic acid or the ester-forming derivative thereof and the isophthalic acid or the ester-forming derivative thereof in the copolymerized polyester (I) be within the range of from about 95:5 to about 50:50.

Preferred as the glycol component to be used in the copolymerized polyester (I) is an alkylene glycol selected from the group consisting of ethylene glycol, propylene glycol, tetramethylene glycol, and pentamethylene glycol.

Furthermore, the ester-forming alkali metal sulfonate in the copolymerized polyester (I) is preferably an alkali metal salt of an acid compound selected from the group consisting of sulfoterephthalic acid, 5-sulfoisophthalic acid, 4-sulfophthalic acid and 4-sulfonaphthalene-2,7-dicarboxylic acid or an ester-forming derivative of such an alkali metal salt. More preferred examples of the ester-forming alkali metal sulfonate include sodium 5-sulfoisophthalate, sodium sulfoterephthalate, potassium 5-sulfoisophthalate, and potassium sulfoterephthalate. The quantity of the ester-forming alkali metal sulfonate in the copolymerized polyester (I) is preferably selected within the range of from about 0.2 mol per cent to about 40 mol per cent or, more preferably, within the range of from about 5 mol per cent to about 20 mol per cent with respect to the total quantity of the carbonic acid component in the copolymerized polyester (I). If the proportion of the ester-forming alkali metal sulfonate is less than the preferred lower limit of about 0.2 mol per cent, the resultant copolymer would fail to provide satisfactory degrees of solubility in water and stability in its liquid phase and would thus result in an excess degree of smoothness which leads to degradation of the packing work performance of the resultant polyester fibers. On the other hand, a proportion of the ester-forming alkali metal sulfonate in excess of the preferred upper limit of 40 mol per cent would give rise to a steep increase in the melt viscosity of the resultant copolymer and would in the result make it impossible to produce a highly polymerized copolymer by a melt polymerization process. It may further be noted that, if the alkali metal in the ester-forming alkali metal sulfonate to be contained in the copolymerized polyester (I) is substituted by any non-alkali metal, the polyester fibers processed with the resultant copolymer would fail to provide an adequate degree of dispersibility in water and would accordingly jeopardize to achieve the prime object of the present invention.

Preferred examples of the lower polyalkylene glycol to be used in the copolymerized polyester (I) include polyethylene glycol, polypropylene glycol and a polyethylene glycol-polypropylene glycol copolymer each having a molecular weight within the range of from about 500 to about 12,000 or, preferably, within the range of from about 600 to about 6,000. The use of a polyalkylene glycol with a molecular weight of less than the preferred lower limit of about 500 would result in deterioration of the dispersibility of the fibers in water. If, on the other hand, the molecular weight of the polyalkylene glycol used is larger than the preferred upper limit of 12,000, then an excess of smoothness of the polyester fibers would result and impair the packing factor of the fibers. As the polyalkylene glycol in the copolymerized polyester (I) may also be used a monoether of a polyalkylene glycol such as, for example, a monomethyl ether, a monoethyl ether, a monophenyl ether or the like of polyethylene glycol, polypropylene glycol, or the like. From the view point of increasing the dispersibility of the polyester fibers in water, the most preferred of these is a monoether of polyethylene glycol. The quantity of the polyalkylene glycol to be contained in the copolymerized polyester (I) is preferably within the range of from about 20 per cent by weight to about 90 per cent by weight or, more preferably, within the range of from about 30 per cent by weight to about 80 per cent by weight with respect to the quantity of the copolymer to be produced. If the quantity of the polyalkylene glycol used is less than the preferred lower limit of 20 per cent by weight with respect to the quantity of the copolymerized polyester to be produced, a satisfactory degree of dispersiblity in water of the polyester fibers could not be achieved. On the other hand, a quantity of the polyalkylene glycol larger than the preferred upper limit of 90 per cent by weight would result in a decrease of durability of the copolymer deposited on the polyester fibers and, as a consequence, the contribution of the copolymer to the mechanical strengths and the feel of the paper produced from the resultant polyester fibers would be crucially lessened.

While the copolymerized polyester (I) alone may be deposited to the polyester fibers according to the present invention, such a polyester may be used in the form of a mixed compound further containing a second copolymerized polyester (II). This second copolymerized polyester (II) preferably comprises terephthalic acid or an ester-forming derivative of the terephthalic acid, isophthalic acid or an ester-forming derivative of the isophthalic acid, a lower alkylene glycol, and one or both of a polyalkylene glycol and a monoether thereof. Polyester fibers with a quantity of on-the-flat-screen-plate residual fibers of less than about 1,000 mg and a packing factor of more than 40 can also be obtained by application of the mixture of these two copolymerized polyesters (I) and (II). To increase the dispersibility of the polyester fibers in water, it is important to use both of the terephthalic acid or the ester-forming derivative thereof and the isophthalic acid or the ester-forming derivative thereof providing the two acid components of the second copolymerized polyester (II) as in the case of the copolymerized polyester (I). In this instance, it is also preferable that the ratio between the terephthalic acid or the ester-forming derivative thereof and the isophthalic acid or the ester-forming derivative thereof in the copolymerized polyester (II) be within the range of from about 95:5 to about 50:50.

Preferred as the glycol component to be used in the second copolymerized polyester (II) is a lower alkylene glycol selected from the group consisting of ethylene glycol, propylene glycol, tetramethylene glycol, and pentamethylene glycol. Furthermore, preferred examples of the polyalkylene glycol in the copolymerized polyester (II) include polyethylene glycol, polypropylene glycol and a polyethylene glycol-polypropylene glycol copolymer each having a molecular weight within the range of from about 500 to about 12,000 or, preferably, within the range of from about 600 to about 6,000. These ranges of the molecular weight are identical with those of the molecular weight of the polyalkylene glycol contained in the first copolymerized polyester (I) and are thus preferred for the same reasons as those explained in connection with the copolymerized polyester (I). As the polyalkylene glycol monoether which may be contained in the copolymerized polyester (II) for the purpose of improving the dispersibility of the polyester fibers in water may also be used a monomethyl ether, a monoethyl ether, a monophenyl ether or the like of a polyethylene glycol, a polypropylene glycol, or the like. From the view point of increasing the dispersibility of the polyester fibers in water, the most preferred of these monoethers is a monoether of polypropylene glycol. The dispersibility of the polyester fibers in water will be further improved when the quantities of the two acid components and the polyalkylene glycol contained in the copolymerized polyester (II) are selected so that the molar ratio between the total quantity of the terephthalic and isophthalic acids or the ester-forming derivatives thereof and the quantity of the polyalkylene glycol falls within the range of from about 3:1 to about 10:1.

To provide a satisfactory degree of packing work performance of the polyester fibers using the mixture of the first and second copolymerized polyesters (I) and (II), the quantity of the mixed compound is preferably proportioned so that the quantity of the former accounts for about 20 per cent by weight or more of the total quantity of the mixed compound. Each of these two copolymerized polyesters (I) and (II) can be synthesized by the ordinary synthesis method used for the synthesis of polyethylene terephthalate. Thus, for example, desired quantities of a dimethyl dicarboxylic acid ester and a glycol are heated in the presence of an ester interchange type catalyst at a temperature within the range of from about 140° C. to about 240° C. to cause the ester interchange reaction to proceed, while distilling off the methyl alcohol produced. An appropriate ordinary catalyst and an anti-coloring compound such as, for example, a phosphorous ester or a phosphoric ester, and one or both of a polyalkylen glycol and an ester-forming alkali metal sulfonate each of a predetermined quantity are thereafter added. The resultant ethylene glycol is then removed by distillation at a temperature within the range of from about 200° C. to about 275° C. under the partial vacuum of less than about 0.5 mm of Hg, thereby causing the polycondensation reaction to proceed. In carrying out this synthesis process, a small quantity of appropriate hindered phenol or any other type of antioxidant having a relatively high boiling point may be added before or simultaneously when the polyalkylene glycol is added. This will prove beneficial for obtaining a highly heat-resistant copolymer compound which may be subjected to the attack of an elevated temperature during a subsequent process.

It may be noted that the intrinsic viscosity of each of the copolymerized polyesters (I) and (II) may be selected arbitrarily but is preferably selected to be less than about 1.0 (when measured at 25° C. in 0-chlorophenol) since a higher intrinsic viscosity would impair the dispersibility of the copolymerized polyesters in water.

The copolymerized polyesters (I) and (II) used in the polyester fibers according to the present invention can thus be easily and efficiently dispersed in water. To improve the stability of the aqueous dispersion thus obtained, it is preferable that one or more of an anionic surfactant such as a potassium laurylphosphate and a nonionic surfactant such as fatty acid alcohol with an additive of ethylene oxide be added to the copolymerized polyester (I) or to the mixture of the copolymerized polyesters (I) and (II). Furthermore, the copolymerized polyester (I) or the mixture of the copolymerized polyesters (I) and (II) may be dissolved in any water soluble organic solvent having a relatively low boiling point such as, for example, an alcohol such as methyl alcohol, ethyl alcohol and propyl alcohol, an ether such as dioxane ethylene glycol ethyl ether or an ester such as ethyl acetate. The resultant solution is admixed to water containing a suitable surfactant so that the copolymer or the copolymer compound is dispersed in the mixture of the water and the surfactant to obtain an aqueous solution of the copolymerized polyester (I) or the mixture of the copolymerized polyesters (I) and (II). The use of organic solvent used in addition to the surfactant is advantagous in that it permits of reduction of the quantity of the surfactant to be used. The solvent thus used may be removed from the aqueous dispersion if desired.

When dispersed in water or when applied to the polyester fibers, the copolymerized polyester (I) or the mixture of the copolymerized polyesters (I) and (II) may be coagulated into particles of appreciable sizes. These particles may result in formation of stained deposits on the polyester fibers and/or may shorten the lifetime of the paper or paperproduct to be produced from the polyester fibers. To preclude formation of such particles, it is preferable that an appropriate anionic or nonionic surfactant be added to the copolymerized polyester (I) or the mixture of the copolymerized polyesters (I) and (II). Such a surfactant may be selected from the following substances:

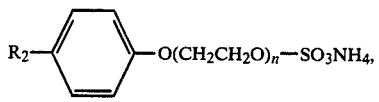
(a)

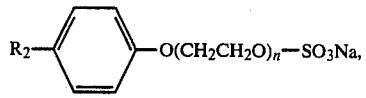
(b)

$R_3—O(CH_2CH_2O)_n—SO_3NH_4$, (c)

$R_3—O(CH_2CH_2O)_n—SO_3Na$, (d)

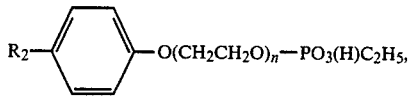
(e)

and $R_3—O(CH_2CH_2O)_n—PO_3(C_2H_5)_2$, (f)

where $R_2$ represents an alkyl radical having a carbon number of 3 or more or, preferably within the range of from 9 to 18, $R_3$ represents an alkyl radical having a carbon number of 6 or more or, preferably within the range of from 8 to 25, and n is an integer within the range of from 4 to 20. Particularly preferred of these surfactants (a) to (f) the sulfuric acid ester type anionic surfactants of alkylaryl polyesters as represented by the formulae (a) to (c).

The production of the above mentioned particles can be precluded if a small quantity of appropriate acid or appropriate water soluble salt is added to the copolymerized polyester (I) or to the mixture of the copolymerized polyesters (I) and (II). The acid operable for this purpose may be an organic acid such as for example formic acid, acetic acid, oxalic acid, sulfamic acid or momochloroacetic acid, an inorganic acid such as for example chloric acid or phosphoric acid, or a potential acid of the type which hydrolyzes at an elevated temperature to produce an acid. Examples of such a potential acid include glycol diacetate, diacetin, monochloroglycerin, dichloroglycerin, lactone and sultone. On the other hand, the water soluble salt may be any of, for example, ammonium sulfate, sodium sulfate, sodium acetate, ammonium chloride and sodium chloride.

The copolymerized polyester (I) or the mixture of the copolymerized polyesters (I) and (II) used in the polyester fibers according to the present invention may be applied to the polyester fibers in any desired manner but is preferably applied thereto in the form of an aqueous dispersion of, preferably, any of the above described natures. The step to have the polyester compound applied to the polyester fibers may be taken at any stage prior to the papermaking process but is preferably executed subsequently to drawing of the polyester fibers. The polyester fibers thus drawn and processed with the copolymerized polyester (I) or the mixture of the copolymerized polyesters (I) and (II) in the form of, for example, an aqueous dispersion may then be subjected to heat treatment and thereafter cut into desired staple lengths.

The quantity of the copolymerized polyester (I) or the mixture of the copolymerized polyesters (I) and (II) to be deposited on each of the polyester fibers is preferably within the range of from about 0.01 per cent by weight to about 2 per cent by weight or, more preferably, within the range of from about 0.04 per cent by weight to about 1.5 per cent by weight. If the quantity of deposit of the copolymerized polyester (I) or the mixture of the copolymerized polyesters (I) and (II) on each polyester fiber is less than the preferred lower limit of about 0.01 per cent by weight, there could not be achieved a satisfactory degree of dispersibility in water of the polyester fibers during papermaking process. A quantity of deposit in excess of the preferred upper limit of 2 per cent by weight would result in production of more fly wastes when the fibers are to be fed into a beater during papermaking operation and might thus provide difficulties in handling the material. The copolymerized polyester (I) or the mixture of the copolymerized polyesters (I) and (II) may be applied by a conventional process such as a dipping process or a spraying process.

The outstanding features and advantages of the polyester fibers according to the present invention will be more precisely understood from the following examples of the polyester fibers prepared in accordance with the present invention.

EXAMPLE 1

A mixture of 18 parts by weight of dimethyl terephthalate (DMT), 4.4 parts by weight of dimethyl isophthalate (DMI), 17.2 parts by weight of ethylene glycol, and 0.0002 part by weight of calcium acetate as an ester interchange catalyst was stirred and thereafter put into a reactor having a rectification column and a methyl alcohol distillation condenser. The mixture was heated at a temperature ranging between 140° C. and 230° C. in this reactor to cause the ester interchange reaction to proceed therein, while causing the resultant methyl alcohol to be distrilled off. Thereupon, 0.0001 part by weight of normal phosphoric acid, 0.0002 part by weight of antimony trioxide, 3.7 parts by weight of 5-sodium sulfoisophthalate glycol ester (SI) and 56.6 parts by weight of polyethylene glycol having an average molecular weight of 3000 were additionally put into the reactor. The resultant mixture was heated gradually from about 230° C. to about 275° C. with a vacuum developed gradually from about 760 mm of Hg to about 0.5 mm of Hg to cause the polycondensation reaction to proceed for 100 minutes. Upon termination of the polycondensation reaction, the reaction product was removed from the reactor and was allowed to cool and solidify at an ambient temperature until a white-colored substance was obtained as a copolymerized polyester (I).

Nine point five parts by weight of the copolymerized polyester (I) thus obtained was melted at 250° C. in a stream of nitrogen gas and was put with stirring into 90 parts of preliminarily prepared 0.5 per cent aqueous solution of POE (15) nonylphenylether ammonium sulfate, thus producing an emulsion of the copolymerized polyester (I).

On the other hand, undrawn filaments each of 4 denier were prepared in a known manner from the chips of polyethylene terephthalate having an intrinsic viscosity of 0.64. The filaments were gathered together into the form of an approximately $5\times10^5$-denier tow, which was drawn with a draw ratio of 3.2 times at a drawing rate of 80 meters per minute. The resultant tow was introduced into the emulsion of the copolymerized polyester (I) prepared as described above and was heated therein at 120° C. The tow thus processed in the emulsion of the copolymerized polyester (I) was cut into 20 mm long staples each of 1.5 denier with a deposite of 0.3 per cent by weight of the copolymerized polyester (I) thereon.

The packing factor of the polyester fibers thus processed was measured with use of the method described with reference to FIG. 3 and was determined to be 64. The polyester fibers were then packed in the baling box of a box-type staple baling machine and, upon completion of the packing operation, the door of the box was opened up to see if any fragments of the bale may slip down out of the box. The result was that there was no slipdown of the fibers forming the bale in the box, assuring a smooth stream of the baling operation.

The polyester fibers obtained were further measured for the quantity of on-the-flat-screen-plate residual fibers thereof with use of the flat screen strainer of the type described with reference to FIGS. 1 and 2. The flat screen plate used in the strainer was formed with a total of 120 slots arranged in three arrays and each measuring 1.213 mm in width and about 108 mm in length. The result of the measurement shows that the quantity of on-the-flat-screen-plate residual fibers of the polyester fibers was 55 mg, which is a sufficiently acceptable value.

EXAMPLES 2–5

Polyester fibers according to the present invention were further prepared as Examples 2 to 5 in manners essentially similar to the manner used for preparation of Example 1, with copolymerized polyesters (I) of different quantities deposited on the polyester fibers. Tests were conducted with these Examples 2 to 5 for the packing factor, packing work performance, quantity of on-the-flat-screen-plate residual fibers, and dispersibility in water of the polyester fibers. The results of these tests are shown in Table 1 in which the column of "Total rating" shows the results of the comprehensive evaluation of the quality of the polyester fibers tested. In Table 1 and also in Tables 2 to 4 to be shown, the sign "++" (plus plus) refers to "excellent", the sign "+" (plus) refers to "acceptable", the sign "o" (zero) refers to "mediocre", and the sign "−" (minus) refers to "unacceptable".

TABLE 1

| | Deposit of (I) (wt %) | Packing factor | Packing performance | Residual fibers (mg) | Dispersibility | Total Rating |
|---|---|---|---|---|---|---|
| Example 2 | 1.5 | 64 | ++ | 10 | ++ | ++ |
| Example 3 | 0.1 | 64 | ++ | 270 | ++ | ++ |
| Example 4 | 0.03 | 68 | ++ | 500 | + | + |
| Example 5 | 0.01 | 75 | ++ | 950 | o | + |

EXAMPLES 6 TO 12 AND COMPARATIVE EXAMPLES 1 TO 7

Polyester fibers according to the present invention were further prepared as Examples 6 to 12 in manners similar to the manner used for the preparation of Example 1, using copolymerized polyesters (I) of various chemical compositions as indicated in Table 2. For comparison with these Examples 6 to 12, samples of polyester fibers were further prepared as Comparative Examples 1 to 7 using copolymerized polyesters with chemical compositions differing from those of the copolymerized polyesters (I) in Examples 6 to 12. Tests were also conducted with these Examples 6 to 12 and Comparative Examples 1 to 7 for the packing factor, packing work performance, quantity of on-the-flat-screen-plate residual fibers, and dispersibility in water of the polyester fibers. The results of these tests are shown in Table 3.

TABLE 2

| | Dicarboxylate (Mol %) | | | Polyethylene glycol | |
|---|---|---|---|---|---|
| | DMT* | DMI** | SI*** | Mol wt | Wt % |
| Comparative Example 1 | 80 | 19.9 | 0.1 | 3,000 | 70 |
| Example 6 | 80 | 19.9 | 0.5 | 3,000 | 70 |
| Example 7 | 80 | 10 | 10 | 3,000 | 70 |
| Example 8 | 55 | 15 | 30 | 3,000 | 70 |
| Comparative Example 2 | 40 | 10 | 50 | 3,000 | 70 |
| Comparative Example 3 | 80 | 10 | 10 | 400 | 70 |
| Example 9 | 80 | 10 | 10 | 600 | 70 |
| Example 10 | 80 | 10 | 10 | 8,000 | 70 |
| Comparative Example 4 | 80 | 10 | 10 | 13,000 | 70 |
| Comparative Example 5 | 80 | 10 | 10 | 3,000 | 10 |
| Example 11 | 80 | 10 | 10 | 3,000 | 30 |
| Example 12 | 80 | 10 | 10 | 3,000 | 50 |
| Comparative Example 6 | 80 | 10 | 10 | 3,000 | 95 |
| Comparative Example 7 | 90 | 0 | 10 | 3,000 | 70 |

*Dimethyl terephthalate
**Dimethyl isophthalate
***5-sodium sulfoisophthalate glycol ester

TABLE 3

| | Packing factor | Packing performance | Residual fibers (mg) | Dispersibility | Total Rating |
|---|---|---|---|---|---|
| Comp. Example 1 | 31 | – | 20 | ++ | – |
| Example 6 | 48 | + | 25 | ++ | + |
| Example 7 | 63 | ++ | 35 | ++ | ++ |
| Example 8 | 66 | ++ | 50 | ++ | ++ |
| Comp. Example 2* | – | – | – | – | – |
| Comp. Example 3 | 70 | ++ | 1,300 | – | – |
| Example 9 | 68 | ++ | 800 | o | + |
| Example 10 | 48 | + | 20 | ++ | + |
| Comp. Example 4 | 28 | – | 10 | ++ | – |
| Comp. Example 5 | 70 | ++ | 1,250 | – | – |
| Example 11 | 68 | ++ | 500 | + | + |
| Example 12 | 67 | ++ | 270 | + | + |
| Comp. Example 6 | 30 | – | 960 | o | – |
| Comp. Example 7 | 29 | – | 1,700 | – | – |

*A copolymerized polyester could not be synthesized.

It will be seen from the results shown in Table 3 that each of the polyester fibers of Examples 6 to 12 has a packing factor of more than 40 and a quantity of on-the-flat-screen-plate residual fibers of less than 1,000 mg and is thus acceptable in packing work performance and dispersibility in water. The polyester fibers of Comparative Examples are however unacceptable in respect of the packing work performance and/or dispersibility in water in that each of these, particularly Comparative Examples 1, 4, 6 and 7 has a packing factor of less than 40 and some of them, for example Comparative Examples 3, 5 and 7 have quantities of on-the-flat-screen-plate residual fibers of less than 1,000 mg.

EXAMPLES 13 TO 16 AND COMPARATIVE EXAMPLE 8

Non-oriented filaments were prepared and bundled into tows and the resultant tows drawn in a manner similar to the manner used for the preparation of the polyester fibers for Example 1. The resultant tow was introduced into the mixture of first and second copolymerized polyesters (I) and (II). The copolymerized polyester (I) herein used was prepared also in manners similar to the manner used for the preparation of the first copolymerized polyester (I) for Example 1. The second copolymerized polyester (II) was prepared as follows.

A mixture of 20 parts by weight of dimethyl terephthalate (DMT), 5 parts by weight of dimethyl isophthalate (DMI), 17.2 parts by weight of ethylene glycol, and 0.0002 part by weight of calcium acetate as an ester interchange catalyst was put into a reactor having a stirrer, a rectification column and a methyl alcohol distillation condenser. The mixture was heated at a temperature ranging between 140° C. and 230° C. in this reactor to cause the ester interchange reaction to proceed therein, while causing the resultant methyl alcohol to be distrilled off. Thereupon, 0.0001 part by weight of normal phosphoric acid, 0.0002 part by weight of antimony trioxide and 56.6 parts by weight of polyethylene glycol having an average molecular weight of 3000 were additionally put into the reactor. The resultant mixture was heated gradually from 230° C. to 275° C. with a vacuum developed gradually from 760 mm of Hg to 0.5 mm of Hg to cause the polycondensation reaction to proceed for 100 minutes. Upon termination of the polycondensation reaction, the reaction product was removed from the reactor and was allowed to cool and solidify at an ambient temperature until a white-colored substance was obtained as the second copolymerized polyester (II). Nine point five parts by weight of the copolymerized polyester (II) thus obtained was melted at 250° C. in a stream of nitrogen gas and was put with stirring into 90 parts of preliminarily prepared 0.5 per cent aqueous solution of POE nonylphenylether ammonium sulfate, thus producing an emulsion of the second copolymerized polyester (II).

The emulsions of the first and second copolymerized polyesters (I) and (II) thus prepared were mixed together in five different proportions. The tows of the drawn polyester filaments prepared as described above were processed in the mixture of these emulsions and were then cut into approximately 15 mm long staples each of 1.5 denier with a deposite of 0.3 per cent by weight of the copolymerized polyesters (I) and (II) thereon. Examples 13 to 16 of the polyester fibers according to the present invention and Comparative Example 8 for comparison therewith were prepared.

These Examples 13 to 16 and Comparative Example 8 resulted from the mixtures of the copolymerized polyesters (I) and (II) mixed in the ratios of 100:0, 80:20, 50:50, 20:80 and 0:100, respectively.

Tests were conducted with these Examples 13 to 16 and Comparative Example 8 for the packing factor, packing work performance, quantity of on-the-flat-screen-plate residual fibers, and dispersibility in water of the polyester fibers. The flat screen plate of the strainer used for the measurement of the quantity of on-the-flat-screen-plate residual fibers was formed with three arrays each of 53 slots each measuring 0.916 mm in width and 108 mm in length. The results of these tests are shown in Table 4.

TABLE 4

| | Ratio (I):(II) | Packing factor | Packing performance | Residual fibers (mg) | Dispersibility | Total Rating |
|---|---|---|---|---|---|---|
| Example 13 | 100:0 | 63 | ++ | 53 | ++ | ++ |
| Example 14 | 80:20 | 51 | + | 14 | ++ | + |
| Example 15 | 50:50 | 49 | + | 15 | ++ | + |
| Example 16 | 20:80 | 47 | + | 14 | ++ | + |
| Comparative Example 8 | 0:100 | 29 | − | 10 | ++ | − |

The results shown in Table 4 tell that a proportion of the first copolymerized polyester (I) less than 20 per cent results in an unacceptable degree of packing work performance of the polyester fibers as will be seen from comparison of Comparative Example 8 with each of Examples 13 to 16. Where both of the first and second copolymerized polyesters (I) and (II) are to be used in the polyester fibers according to the present invention, it is for this reason of importance that the quantity of the former accounts for 20 per cent or more of the total quantity of the mixture. Experiments have further revealed that the use of the first copolymerized polyester (I) in a larger proportion further results in an increase in the hardness of the paper produced from the resultant polyester fibers and that, when the copolymerized polyester (I) is used in a smaller proportion, the paper exhibits a soft hand or feel.

As will have been understood from the foregoing description, the polyester fibers proposed by the present invention are useful for the prevention of the slipdown of the fragments of the bale formed in the baling box of a box-type fiber packing machine and accordingly providing satisfactory degrees of packing work performance. The polyester fibers according to the present invention are further excellent in dispersibility in water and are useful particularly as papermaking materials providing paper and paper products with excellent mechanical strengths and increased degrees of feels, hands and textures.

While the polyester fibers proposed by the present invention may be used independently of any other types of natural or synthetic fibers, they may be used in combination with wood fibers, rayon fibers, vinylon fibers, nylon fibers, propylene fibers and/or glass fibers. It may also be noted that because of the increased degrees of the water dispersibility of the polyester fibers according to the present invention, any viscosity increasing agent which may be used to increase the viscosity of the the aqueous dispersion of fibers need not be added to the aqueous dispersion during pulpmaking process. A viscosity increasing agent may thus be used only for the control of freeness of the pulp material during beating operation. This will prove beneficial from the standpoint of process control for the papermaking operation.

What is claimed is:

1. A paper making polyester fiber, the improvement comprising that the papermaking polyester fiber comprises a copolymer containing a dicarboxylic acid component and has applied to the surface thereof a copolymerized polyester (I) which consists of (A) a polyester comprising terephthalic acid or an ester-forming derivative of terephthalic acid, isophthalic acid or an ester-forming derivative of isophthalic acid and a lower alkylene glycol (b) about 0.2 mol percent to about 40 mol percent, with respect to the quantity of the dicarboxylic acid component in the copolymer to be produced, of an ester-forming alkali metal sulfonate and (c) about 20 percent by weight to about 90 percent by weight, with respect to the quantity of the copolymer to be produced, of a polyethylene glycol having an average molecular weight within the range of from about 500 to 1200, wherein the paper making polyester fiber has a denier number within the range of from about 0.1 to about 3.0 and a length within the range from about 5 mm to about 25 mm, and provides a packing factor of more than about 40 and a quantity of residual fibers of less than about 1000 mg on a flat screen plate when measured by the flat screen method.

2. A papermaking polyester fiber as set forth in claim 1, the improvement further comprising that said quantity of residual fibers on a flat screen plate is less than about 500 mg.

3. A papermaking polyester fiber as set forth in claim 1, the improvement further comprising that said quantity of residual fibers on a flat screen plate is less than about 300 mg.

4. A papermaking polyester fiber as set forth in claim 1, wherein said packing factor is more than about 45.

5. A papermaking polester fiber as set forth in claim 1, 2, 3 or 4, wherein said fiber is selected from the group consisting of fibers of polyethylene terephthalate, polyethylene terephthalate/isophthalate and polybutylene terephthalate.

6. A papermaking polyester fiber as set forth in claim 1, the improvement further comprising that the quantity of said copolymerized polyester (I) to be deposited on the polyester fiber is within the range of from about 0.01 per cent by weight to about 2 per cent by weight.

7. A papermaking polyester fiber as set forth in claim 1, the improvement further comprising that said copolymerized polyester (I) is applied to the polyester fiber in the form of a mixture with a second copolymerized polyester (II) comprising terephthalic acid or an ester-forming derivative of the terephthalic acid, isophthalic acid or an ester-forming derivative of the isophthalic acid, a lower polyalkylene glycol, and one or both of a polyalkylene glycol and a monoether thereof.

8. A papermaking polyester fiber as set forth in claim 7, the improvement further comprising that the quantities of the first and second copolymerized polyesters (I) and (II) in said mixture are selected so that the quantity of the first copolymerized polyester (I) accounts for about 20 per cent by weight or more of the total quantity of the mixture.

9. A papermaking polyester fiber as set forth in claim 7, the improvement further comprising that the ratio between terephthalic acid or the ester-forming derivative thereof and isophthalic acid or the ester-forming derivative thereof in said copolymerized polyester (II) be within the range of from about 95:5 to about 50:50.

10. A papermaking polyester fiber as set forth in claim 7, the improvement further comprising that the quantity of said mixture of the copolymerized polyesters (I) and (II) to be deposited on the polyester fiber is within the range of from about 0.01 per cent by weight to about 2 per cent by weight.

* * * * *